US008555512B2

(12) United States Patent
Hanakawa

(10) Patent No.: US 8,555,512 B2
(45) Date of Patent: Oct. 15, 2013

(54) HANDLE OF TOOL

(75) Inventor: Youichi Hanakawa, Osaka (JP)

(73) Assignee: Kokuyo Co., Ltd., Osaka-Shi, Osaka (JP)

( * ) Notice: Subject to any disclaimer, the term of this patent is extended or adjusted under 35 U.S.C. 154(b) by 571 days.

(21) Appl. No.: 12/662,126

(22) Filed: Mar. 31, 2010

(65) Prior Publication Data

US 2010/0263215 A1 Oct. 21, 2010

(30) Foreign Application Priority Data

Apr. 17, 2009 (JP) ..... P2009-100640

(51) Int. Cl.
*B26B 13/20* (2006.01)

(52) U.S. Cl.
USPC ..... 30/232; 30/254; 30/341

(58) Field of Classification Search
USPC ..... 30/341, 254, 255, 256, 257, 260, 340, 30/232, 323
See application file for complete search history.

(56) References Cited

U.S. PATENT DOCUMENTS

| | | | | |
|---|---|---|---|---|
| 4,091,539 | A * | 5/1978 | Watanabe | 30/341 |
| 5,987,757 | A * | 11/1999 | Schmidt et al. | 30/341 |
| 6,739,057 | B2 * | 5/2004 | Schallenberg | 30/232 |
| 7,373,728 | B2 * | 5/2008 | Ferman et al. | 33/514.1 |
| 7,392,587 | B2 * | 7/2008 | Hasegawa | 30/341 |
| 7,458,160 | B2 * | 12/2008 | Escobar et al. | 30/232 |
| 7,694,423 | B2 * | 4/2010 | Hasegawa | 30/232 |
| 2001/0032392 | A1 * | 10/2001 | Ueno et al. | 30/345 |
| 2002/0170181 | A1 * | 11/2002 | Schallenberg | 30/232 |
| 2003/0101592 | A1 * | 6/2003 | DeBolt | 30/232 |
| 2009/0126202 | A1 | 5/2009 | Racamier | |
| 2010/0293793 | A1 * | 11/2010 | Underhill | 30/232 |

FOREIGN PATENT DOCUMENTS

| | | |
|---|---|---|
| EP | 2 058 091 A1 | 5/2009 |
| JP | 3-3972 | 1/1991 |
| JP | 2003-311041 | 11/2003 |

OTHER PUBLICATIONS

European Search Report dated Jun. 22, 2010.

* cited by examiner

*Primary Examiner* — Omar Flores Sanchez
(74) *Attorney, Agent, or Firm* — McGinn Intellectual Property Law Group, PLLC

(57) ABSTRACT

Each of handles of a pair of scissors includes a hard core member and a soft member softer than the core member and including a contact face portion with which a finger of a user comes in contact, a bottomed recessed hole portion adjacent to the contact face portion and thinner than portions around it, and a through hole portion continuous with the bottomed recessed hole portion. When the user inserts and removes his/her fingers into and from finger rings, the contact face portions escape while compressing the through hole portions and the contact face portions tilt by using the bottomed recessed hole portions as fulcrums. Moreover, the bottomed recessed hole portions and the through hole portions continuous with each other are molded, which allows an elastic deformation property and a shape retaining property of the contact face portions to go together and also contributes to durability of the soft members including the contact face portions.

7 Claims, 10 Drawing Sheets

HANDLE OF TOOL

BACKGROUND OF THE INVENTION

1. Field of the Invention

The present invention relates to a handle of a tool which a user grips to use and particularly to handles of a pair of scissors and other hand tools.

2. Description of the Related Art

Each handle of general scissors is a hard and rigid body made of metal or hard resin and finger rings through which a user puts his/her fingers are not deformed. Therefore, the fingers may hurt if the finger rings do not fit sizes and shapes of the fingers or when the user tightens his/her grip during use.

On the other hand, in the pair of scissors disclosed in Japanese Patent Application Laid-Open No. 2003-311041 described below, soft resin layers are provided on inner periphery sides of finger rings so that the finger rings can be deformed to thereby solve the above problem.

However, the simple provision of the soft resin layers does not necessarily exert sufficient effect and the finger rings might be still hard.

SUMMARY OF THE INVENTION

With the above circumstances in view, it is an object of the present invention to make improvements to a handle of a tool which a user grips to use to thereby provide a more usable tool.

A handle of a tool according to the present invention includes a hard core member and a soft member softer than the core member and having a contact face portion with which a finger of a user comes in contact and a bottomed recessed hole portion adjacent to the contact face portion and thinner than portions around it.

Here, the tool refers to a concept including hand tools such as a spoon, a fork, a knife, a kitchen knife, chopsticks, implements for writing, a pair of pliers, and a screwdriver, a door, crutches, and the like besides a pair of scissors. A handle of the door in the case of the door and grips of the crutches with which palms of hands (bottoms of the palms) of a user come in contact in the case of the crutches are handles according to the present invention.

In the present invention, the bottomed recessed hole portion facilitates displacement or deformation of the contact face portion, imparts an appropriate degree of softness to the contact face portion, and allows the contact face portion to fit a size and a shape of the finger of the user.

Preferably, the soft member has a contact face portion with which the finger of the user comes in contact, the bottomed recessed hole portion adjacent to the contact face portion and thinner than portions around it, and a through hole portion continuous with the bottomed recessed hole portion. If only the through hole portion adjacent to the contact face portion is provided, the contact face portion becomes excessively soft. However, the bottomed recessed hole portion and the through hole portion continuous with each other are molded, which allows an elastic deformation property and a shape retaining property of the contact face portion to go together and also contributes to durability of the soft member including the contact face portion.

If the handle includes a finger hold through which the finger of the user is put and the contact face portion is disposed on at least a part of an inner periphery of the finger hold, the contact face portion escapes while compressing the through hole portion or the contact face portion tilts by using the bottomed recessed hole portion as a fulcrum when the finger is inserted into and removed from the finger hold, which contributes to improvement of usability of the tool.

If the bottomed recessed hole portion and the through hole portion are formed in substantially arc shapes substantially along the inner periphery of the finger hold, it is possible to flexibly deform a wide area of the inner periphery of the finger hold.

If the bottomed recessed hole portion is provided at a side edge of the through hole portion, it is possible to secure the shape retaining property of the contact face portion while adjusting the softness of the contact face portion to an appropriate degree.

The present invention is suitable for use for handles of a pair of scissors. In the handle of each of a pair of scissor bodies turning with respect to each other about a pivot, if the handle includes a finger hold through which the finger of the user is put and the contact face portions are disposed at portions of the inner periphery of the finger hold and facing each other in a direction of a straight line connecting a base end of the handle and the pivot, the soft contact face portions exist in portions against which the fingers are rubbed in cutting operation by using the pair of scissors, which improves usability of the pair of scissors.

If the core member is disposed at an inner portion of the inner periphery of the finger hold and facing the finger hold of the opposite scissor body and the contact face portion is disposed at the other portion, it is preferable because it is easy to apply gripping power to the scissor bodies via the core members in the cutting operation.

According to the present invention, the handle of the tool which the user grips to use is improved and it is possible to provide the more usable tool.

DETAILED DESCRIPTION OF THE PREFERRED EMBODIMENTS

Figure 1:
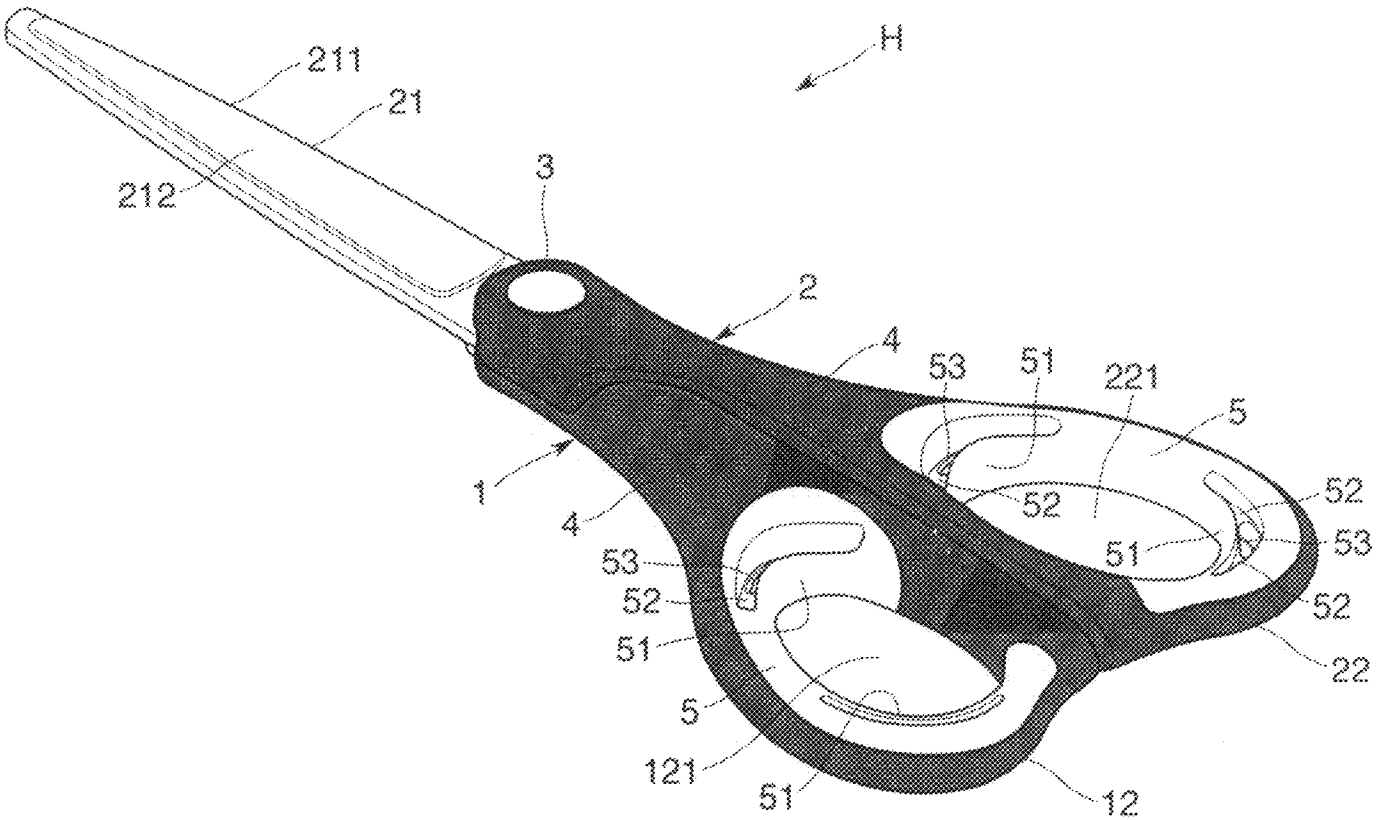
FIG. 1 is a perspective view of a pair of scissors employing handles according to an embodiment of the present invention.
Figure 2:
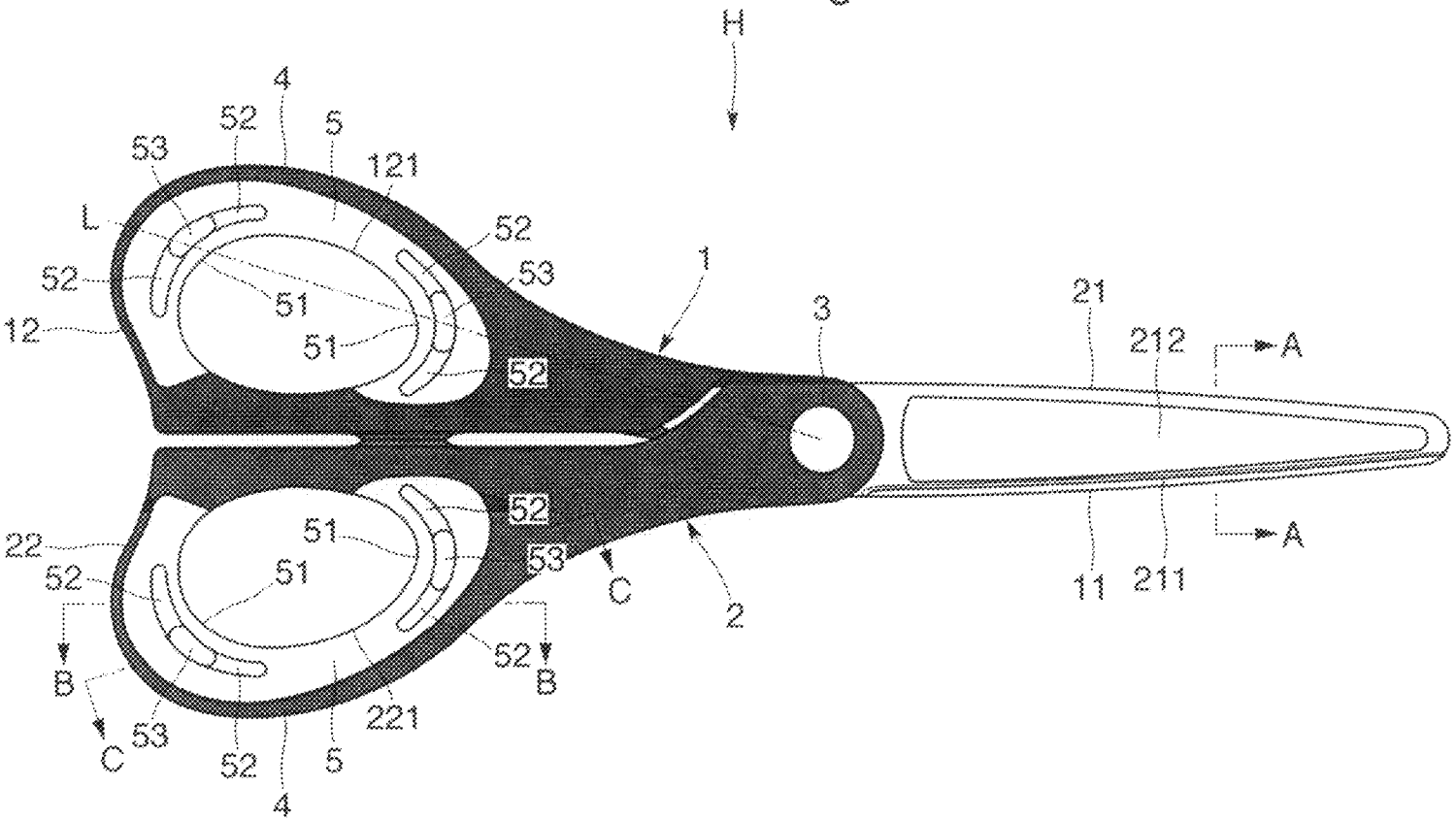
FIG. 2 is a plan view of the pair of scissors according to the embodiment.

An embodiment of the present invention will be described with reference to the drawings. A tool in the embodiment shown in FIGS. 1 and 2 is a pair of scissors H. Similarly to a known pair of scissors H, the pair of scissors H is formed by coupling a first scissor body 1 having a handle 12 mounted to a movable blade 11 and a second scissor body 2 having a handle 22 mounted to a static blade 21 by a pivot 3 so that they can turn with respect to each other.

Both the movable blade 11 and the static blade 21 are made up of metal sheets made of stainless sheets, for example, and are formed by integrally pressing the whole bodies.

Figure 3:
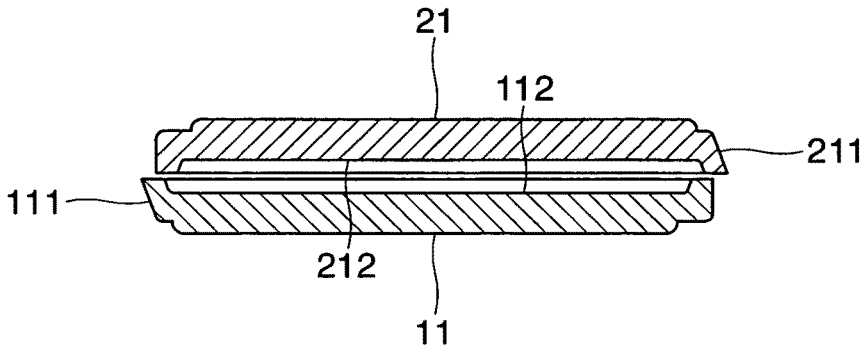
FIG. 3 is a sectional view taken along line A-A and showing blades of the pair of scissors according to the embodiment.

As shown in FIG. 3, the movable blade 11 and the static blade 21 respectively include edge line portions 111 and 211 having flat blade back faces for sliding against (blade back faces of) opposite blades 21 and 11 and recessed portions 112 and 212 adjacent to the edge line portions 111 and 211. The recessed portions 112 and 212 are away from the blade back faces of the opposite blades in a thickness direction with differences in level from the edge line portions 111 and 211 and have bottom faces parallel to the blade back faces. The recessed portions 112 and 212 exist for preventing adhesive or the like applied on back faces of tapes or sheets such as adhesive tapes and kraft tapes from adhering to both the blade back faces of the movable blade 11 and the static blade 21 to impair movements of the scissor bodies 1 and 2 in cutting the tapes or the sheets. The adhesive or the like that has temporarily adhered to the blade back faces is scraped off with the opposite blades and pushed into the recessed portions 112 and 212.

Each of the handles 12 and 22 mounted to the movable blade 11 and the static blade 21 is formed by combining a hard core member 4 and a soft member 5 softer than the core member 4. In FIGS. 1 and 2 (and FIGS. 9 and 10), the core member 4 is shown with halftone dots. The core member 4 is, for example, made of thermoplastic resin material such as polyethylene, polystyrene, polypropylene, ABS resin, and acrylate resin. The soft member 5 is, for example, made of synthetic resin material such as rubber material having elasticity. The handles 12 and 22 are formed by integrally molding the core member 4 and the soft member 5 (especially by two-color molding).

The handle 12 mounted to the movable blade 11 has a finger ring 121 through which a user puts his/her thumb. The handle 22 mounted to the static blade 21 has a finger ring 221 through which the user puts any of his/her index finger, middle finger, and ring finger. Main bodies of the handles 12 and 22, i.e., tip end portions to be mounted to the blades and outer peripheries of the finger rings 121 and 221 are made up of the core members 4. Moreover, inner portions of inner peripheries of the finger rings 121 and 221 and facing the finger rings 221 and 121 of the opposite handles 22 and 12 are made up of the core members 4 as well so that the core members 4 are exposed and come in contact with fingers of the user.

On the other hand, the other portions of the inner peripheries of the finger rings 121 and 221 are made up of the soft members 5 and the soft members 5 are substantially in C shapes in a plan view. The soft members 5 include contact face portions 51 with which the fingers of the user come in contact, bottomed recessed hole portions 52 adjacent to the contact face portions 51 and thinner than portions around them, and through hole portions 53 continuous with the bottomed recessed hole portions 52.

The contact face portions 51 are positioned in portions of the inner peripheries of the finger rings 121 and 221 and facing each other in directions of straight lings L connecting base ends of the handles 12 and 22 and the pivot 3. The bottomed recessed hole portions 52 and the through hole portions 53 are adjacent to outer periphery sides of the respective contact face portions 51. The bottomed recessed hole portions 52 and the through hole portions 53 are extended substantially along the inner peripheries of the finger rings 121 and 221. In other words, the bottomed recessed hole portions 52 and the through hole portions 53 are respectively formed in substantially partial arc shapes or substantially partial elliptic arc shapes.

Figure 4:
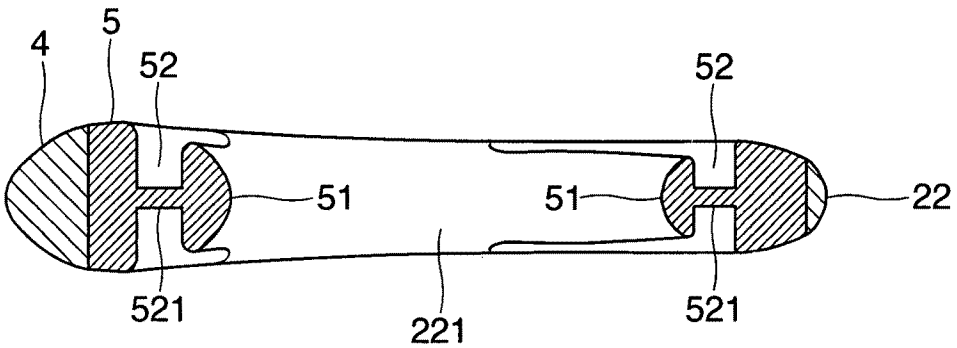
FIG. 4 is a sectional view taken along line B-B and showing the handle of the pair of scissors according to the embodiment.

The bottomed recessed hole portions 52 are bottomed holes or bottomed grooves that reduce wall thickness of the soft member 5 as compared with portions around them. As shown in FIG. 4, in the embodiment, the bottomed recessed hole portions 52 are formed by thinning the scissor bodies 1 and 2 from surface sides and back face sides and there are bottoms 521 at substantially intermediate positions in a thickness direction.

Figure 5:
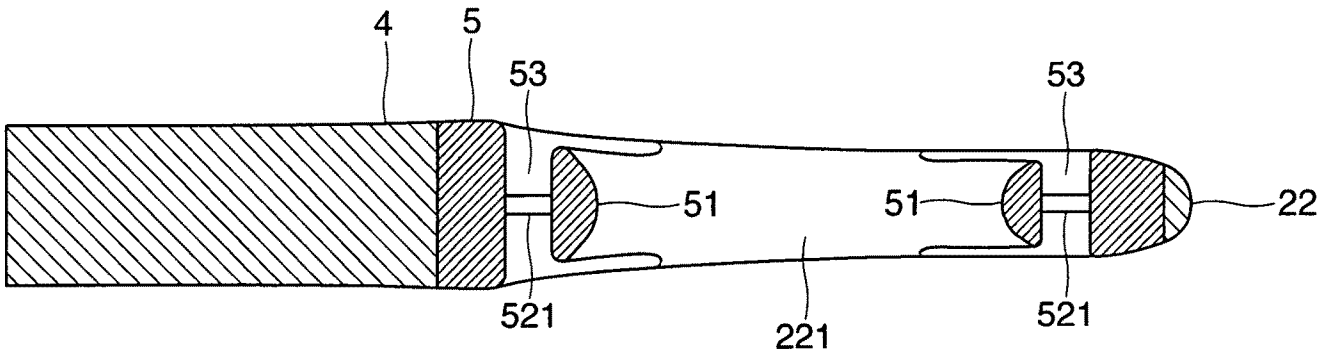
FIG. 5 is a sectional view taken along line C-C and showing the handle of the pair of scissors according to the embodiment.

As shown in FIG. 5, the through hole portions 53 are holes or grooves penetrating the bottoms 521 of the bottomed recessed hole portions 52. In the embodiment, the bottomed recessed hole portions 52 are continuous with opposite sides of the through hole portions 53 in the extended direction. A set of the bottomed recessed hole portions 52 and the through hole portion 53 is in a substantially crescent shape as a whole in the plan view.

Figure 6:
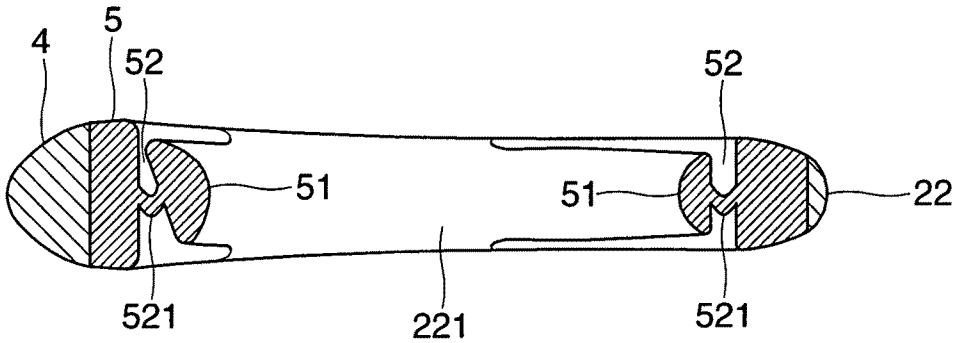
FIG. 6 is a side sectional view corresponding to FIG. 4 and showing a used state of the pair of scissors according to the embodiment.
Figure 7:
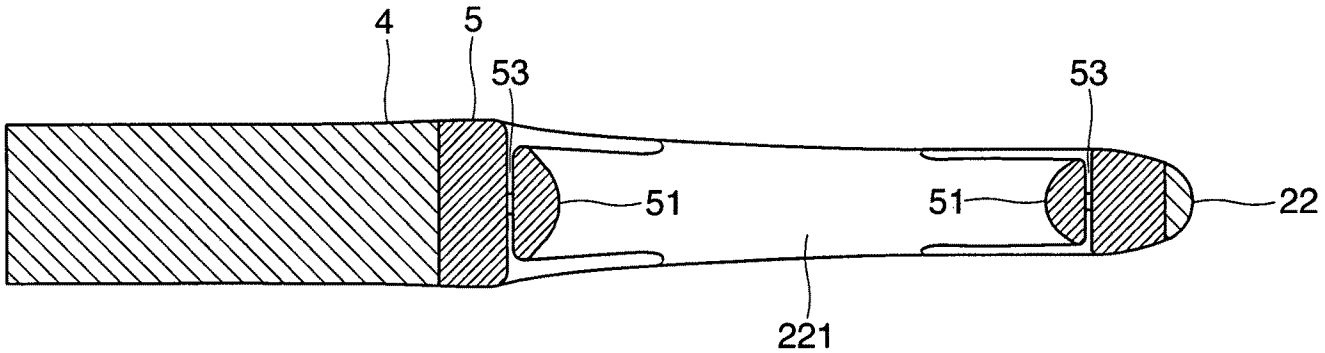
FIG. 7 is a side sectional view corresponding to FIG. 5 and showing the used state of the pair of scissors according to the embodiment.

The bottomed recessed hole portions 52 and the through hole portions 53 facilitate displacement or deformation of the contact face portions 51 and impart an appropriate degree of softness to the contact face portions 51. If the contact face portions 51 are pressed toward the outer periphery sides with the fingers of the user, the bottoms 521 of the bottomed recessed hole portions 52 are compressed as shown in FIG. 6 and/or the through hole portions 53 are compressed as shown in FIG. 7 to thereby allow the contact face portions 51 to escape toward the outer periphery sides.

Figure 8:
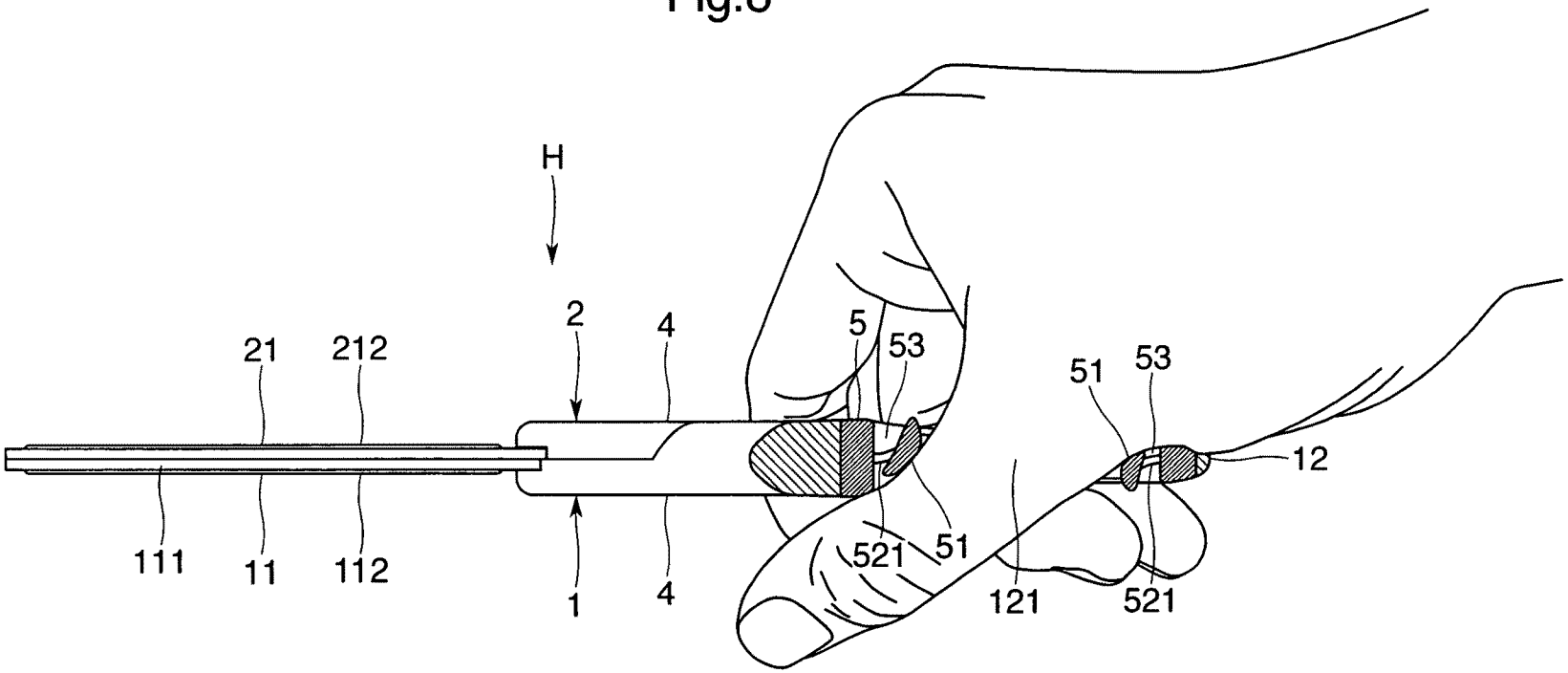
FIG. 8 is a side sectional view showing the used state of the pair of scissors according to the embodiment.

As shown in FIG. 8, it is often the case that the fingers of the user are put through the finger rings 121 and 221 in diagonal directions with respect to the thickness direction, i.e., a direction in which the finger rings 121 and 221 are formed. In this case, the contact face portions 51 can tilt diagonally by using the bottoms 521 of the bottomed recessed hole portions 52 as fulcrums. In a manner of speaking, the finger rings 121 and 221 tilt (or twist) to allow the user to easily insert or remove his/her fingers.

According to the embodiment, the handles 12 and 22 of the pair of scissors H include the hard core members 4 and the soft members 5 softer than the core members 4 and having the contact face portions 51 with which the fingers of the user come in contact, the bottomed recessed hole portions 52 adjacent to the contact face portions 51 and thinner than the portions around them, and the through hole portions 53 continuous with the bottomed recessed hole portions 52. Therefore, the bottomed recessed hole portions 52 and the through hole portions 53 facilitate displacement or deformation of the contact face portions 51, impart softness to the contact face portions 51, and make the contact face portions 51 suitably fit the sizes and the shapes of the fingers of the user.

If only the through hole portions 53 adjacent to the contact face portions 51 are provided, the contact face portions 51 become excessively soft. However, the bottomed recessed hole portions 52 and the through hole portions 53 continuous with each other are molded, which allows an elastic deformation property and a shape retaining property of the contact face portions 51 to go together and also contributes to durability of the soft members 5 including the contact face portions 51.

Because the handles include the finger holds 121 and 221 through which the fingers of the user are put and the contact face portions 51 are disposed on at least parts of the inner peripheries of the finger holds 121 and 221, the contact face portions 51 escape while compressing the through hole portions 53 or the contact face portions 51 tilt by using the bottomed recessed hole portions 52 as the fulcrums when the fingers are inserted into and removed from the finger holds 121 and 221, which contributes to improvement of usability of the pair of scissors H.

Because the bottomed recessed hole portions 52 and the through hole portions 53 are extended substantially along the inner peripheries of the finger holds 121 and 221, it is possible to flexibly deform wide areas of the inner peripheries of the finger holds 121 and 221.

Moreover, because the bottomed recessed hole portions 52 are provided on opposite side edges in an extended direction, i.e., a circumferential direction of each of the through hole portions 53, it is possible to secure the shape retaining property of the contact face portions 51 while adjusting the softness of the contact face portions 51 to an appropriate degree.

The respective handles 12 and 22 of the pair of scissor bodies 1 and 2 turning with respect to each other about the pivot 3 include the finger holds 121 and 221 through which the fingers of the user are put and the contact face portions 51 are disposed at portions of the inner peripheries of the finger holds 121 and 221 and facing each other in the directions of the straight lines L connecting the base ends of the handles 12 and 22 and the pivot 3. Therefore, the soft contact face portions 51 exist in portions against which the fingers are rubbed in cutting operation by using the pair of scissors H, which improves usability of the pair of scissors H.

Moreover, the core members 4 are disposed at the inner portions of the inner peripheries of the finger holds 121 and 221 and facing the finger holds 221 and 121 of the opposite scissor bodies 2 and 1 and the contact face portions 51 are disposed at the other portions, which is preferable because it is easy to apply gripping power to the scissor bodies 1 and 2 via the core members 4 in the cutting operation.

The present invention is not limited to the embodiment described above in detail. Although the handles of the pair of scissors in the above embodiment have annular finger holds with closed peripheral edges, the handles may have non-annular open finger holds with partially lacked peripheral edges.

A positional relationship between the bottomed recessed hole portion and the through hole portion is not limited to that in the embodiment, either. For example, the bottomed recessed hole portion may be provided not at each of the opposite side edges in the extended direction of the through hole portion but at only one of them. Contrary to the bottomed recessed hole portions provided at the opposite side edges of the through hole portion, the through hole portions may be provided at opposite side edges of the bottomed recessed hole portion.

Alternatively, the bottomed recessed hole portion may be provided to be adjacent to an outer periphery side of the contact face portion and the through hole portion may be provided to be adjacent to an outer periphery side of the bottomed recessed hole portion.

Figure 9:
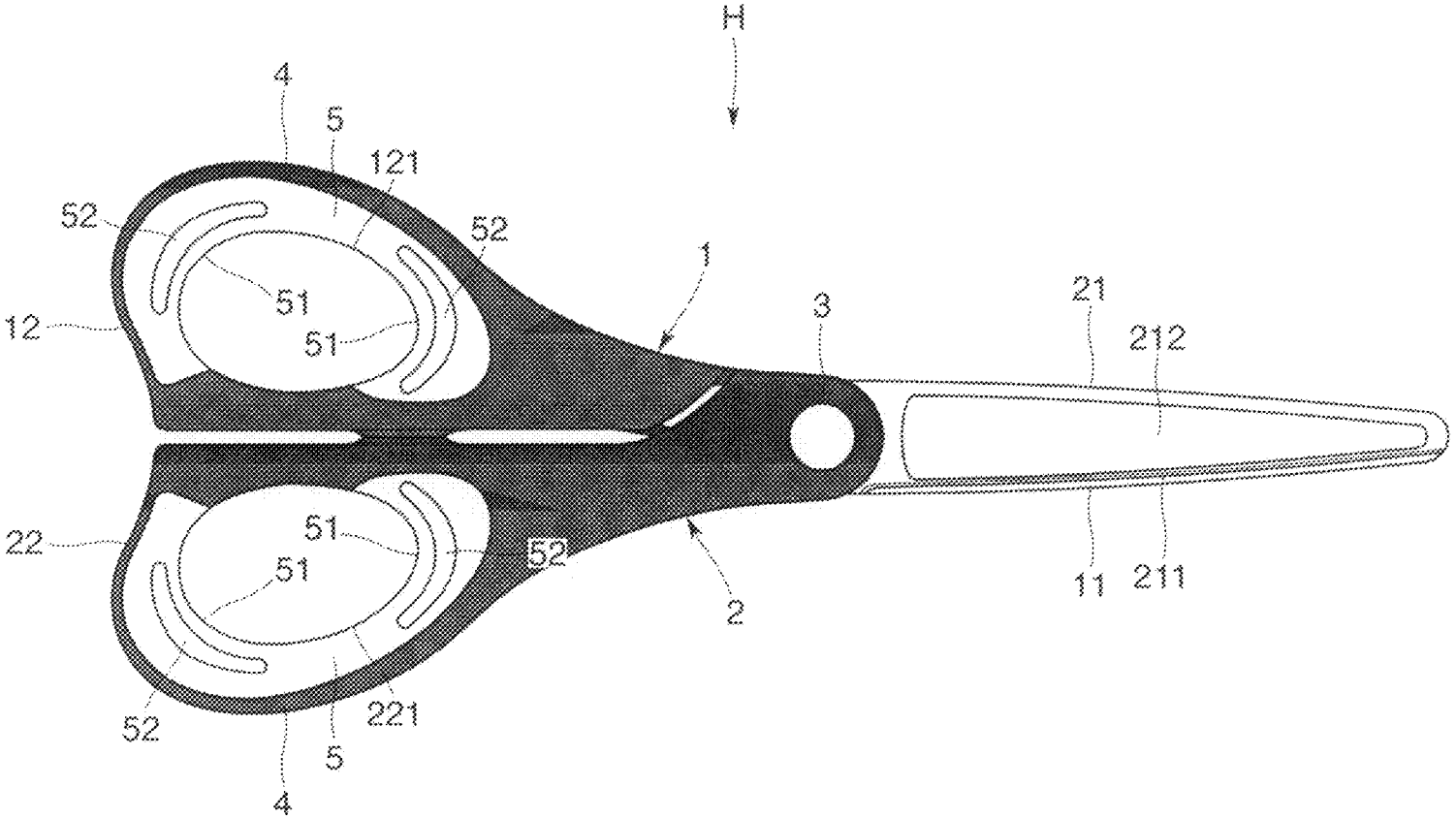
FIG. 9 is a plan view showing a pair of scissors as one variation of the present invention.

Although both the bottomed recessed hole portions 52 and the through hole portions 53 are provided in the soft member 5 in the embodiment, a satisfactory result can be obtained if only the bottomed recessed hole portions 52 are provided in the soft member 5 without providing the through hole portions 53 as shown in FIG. 9.

Figure 10:
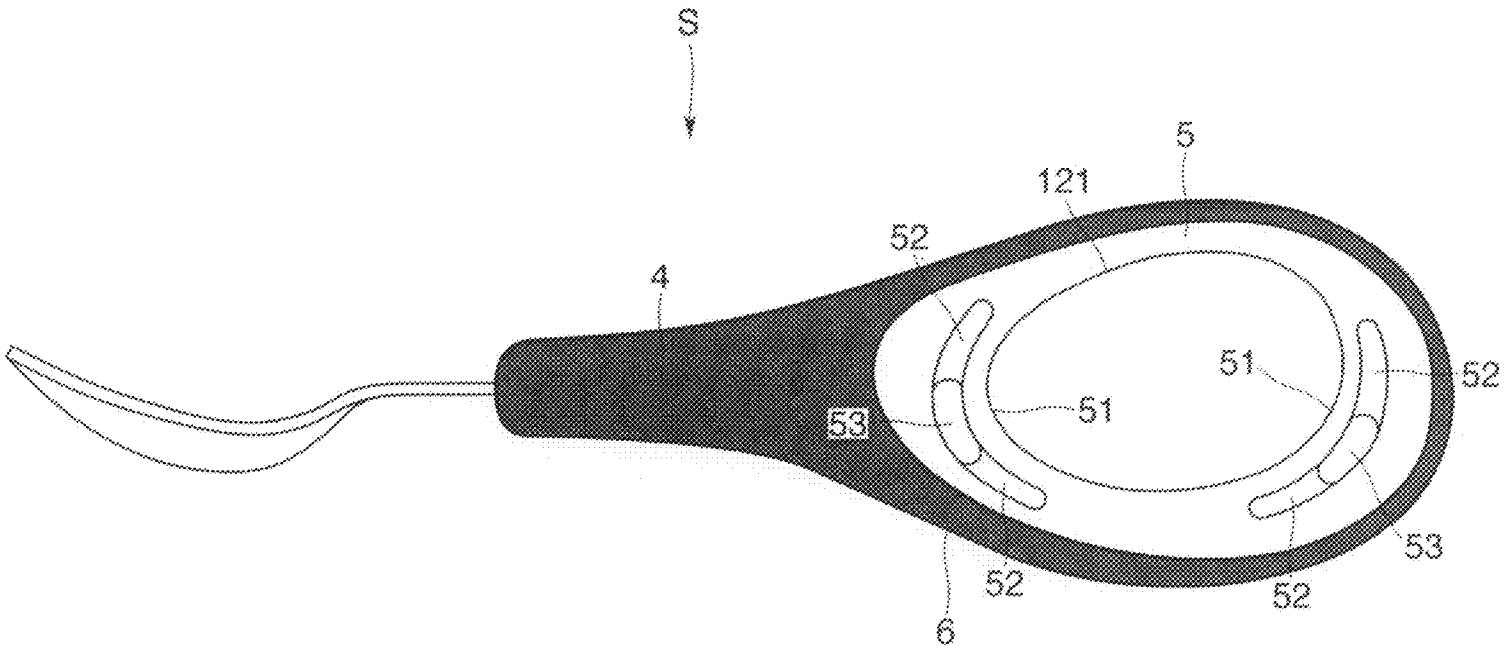
FIG. 10 is a side view of a spoon as another variation of the present invention.

Furthermore, the tool to which the present invention is applied is not limited to the pair of scissors. The handles according to the present invention can be used for hand tools such as a spoon, a fork, a knife, a kitchen knife, chopsticks, implements for writing, a pair of pliers, and a screwdriver, a door handle, grips of crutches, and the like. FIG. 10 shows an example in which the handle 6 of the present invention is applied to a spoon S.

Specific structures of other respective portions can be changed in various ways without departing from the gist of the present invention.

The present invention can be used as handles of hand tools such as scissors, for example.

What is claimed is:

1. A handle of a tool which a user grips to use, the handle comprising:

a hard core member;

a soft member softer than the core member and including:

contact face portions with which a finger of the user comes in contact; and recessed portions adjacent to the contact face portions, and having a thickness less than a thickness of portions around the recessed portions;

a handle formed by combining the hard core member, which comprises a thermoplastic resin material, and the soft member, which comprises a synthetic resin material by a two-color molding; and through hole portions located within the recessed portion, wherein an outer surface of the handle is formed with the hard core member, wherein the recessed portions and the through hole portions are provided behind the contact face portions, wherein the recessed portions and the through hole portions are extended substantially along inner peripheries of finger holds, wherein the recessed portions are provided on opposite side edges of the through hole portion in an extended direction, wherein the handle comprises a handle of each of a pair of scissor bodies turning with respect to each other about a pivot, the handle including a finger hold through which the finger of the user is put, wherein the contact face portions are disposed at portions along a direction of a straight line, and wherein the through hole portions are disposed at portions along the direction of the straight line.

2. The handle according to claim 1, wherein the finger of the user is put into the finger holds, and wherein the contact face portions are disposed on at least a part of the inner peripheries of the finger holds.

3. The handle according to claim 2, wherein the recessed portions and the through hole portions are formed in substantially arc shapes substantially along the inner peripheries of the finger holds.

4. The handle according to claim 3, wherein the recessed portions are provided at side edges of the through hole portions.

5. The handle according to claim 1, wherein the contact face portions are disposed at portions of the inner peripheries of the finger holds.

6. The handle according to claim 5, wherein the hard core member is disposed at an inner portion of the inner peripheries of the finger holds and facing the finger holds of an opposite scissor body, and wherein the contact face portions are disposed at another portion of the inner peripheries of the finger holds.

7. The handle according to claim 1, wherein the hard core member is disposed at an inner portion of the inner peripheries of the finger holds and facing the finger holds of an opposite scissor body, and wherein the contact face portions are disposed at another portion of the inner peripheries of the finger holds.

* * * * *